US010520169B2

(12) United States Patent
Stratas et al.

(10) Patent No.: US 10,520,169 B2
(45) Date of Patent: Dec. 31, 2019

(54) SNAP IN RETROFIT PANEL

(71) Applicant: Flextronics AP, LLC, Broomfield, CO (US)

(72) Inventors: Chris Stratas, Burlingame, CA (US); Jordon Musser, Dallas, TX (US)

(73) Assignee: Flextronics AP, LLC, Broomfield, CO (US)

( * ) Notice: Subject to any disclaimer, the term of this patent is extended or adjusted under 35 U.S.C. 154(b) by 240 days.

(21) Appl. No.: 15/172,067

(22) Filed: Jun. 2, 2016

(65) Prior Publication Data

US 2016/0356430 A1 Dec. 8, 2016

Related U.S. Application Data

(60) Provisional application No. 62/170,536, filed on Jun. 3, 2015.

(51) Int. Cl.

| | |
|---|---|
| ***F21V 17/10*** | (2006.01) |
| ***F21S 8/04*** | (2006.01) |
| ***F21V 19/00*** | (2006.01) |
| ***F21S 8/02*** | (2006.01) |
| ***F21V 3/06*** | (2018.01) |
| ***F21Y 115/10*** | (2016.01) |
| ***F21Y 105/00*** | (2016.01) |

(52) U.S. Cl.

CPC ..... *F21V 17/105* (2013.01); *F21S 8/026* (2013.01); *F21S 8/04* (2013.01); *F21V 19/003* (2013.01); *F21V 3/0625* (2018.02); *F21Y 2105/00* (2013.01); *F21Y 2115/10* (2016.08)

(58) Field of Classification Search

CPC ..... F21S 8/026; F21S 8/04; F21V 17/105; F21V 17/162

See application file for complete search history.

(56) References Cited

U.S. PATENT DOCUMENTS

| | | | | |
|---|---|---|---|---|
| 4,985,817 A * | 1/1991 | Yale | F21L 14/02 248/206.5 |
| 9,279,553 B1 * | 3/2016 | Scribante | F21S 8/026 |
| 9,557,022 B2 * | 1/2017 | Araki | F21S 8/026 |
| 10,012,352 B2 * | 7/2018 | Scribante | F21V 21/03 |

(Continued)

OTHER PUBLICATIONS

Notice of allowance, dated Aug. 1, 2018, U.S. Appl. No. 15/080,430, filed Mar. 24, 2016, applicant: Michael James Glickman, 7 pages.

*Primary Examiner* — William N Harris

(74) *Attorney, Agent, or Firm* — Haverstock & Owens LLP

(57) ABSTRACT

A retrofit lighting fixture for retrofitting a pre-existing lighting fixture. The pre-existing lighting fixture includes electrical wiring and a troffer having a recessed center portion and an outer perimeter edge, which together form a hollow inner cavity, the electrical wiring extending into the cavity. The retrofit lighting fixture includes a lighting panel, a spring and a magnet. The lighting panel has light sources and electrical wiring. The lighting panel electrical wiring is connected to the electrical wiring of the pre-existing lighting. The spring has a first end connected to the lighting panel and a second end connected to the magnet. The magnet is attached to the recessed center portion of the troffer, and the spring is configured to pull the lighting panel against the outer perimeter edge of the troffer. In some applications the retrofit lighting fixture is a LED lighting fixture.

23 Claims, 3 Drawing Sheets

(56) References Cited

U.S. PATENT DOCUMENTS

| | | | | |
|---|---|---|---|---|
| 10,012,355 | B2 * | 7/2018 | Scribante | F21S 8/022 |
| 10,036,514 | B2 * | 7/2018 | Scribante | F21V 21/03 |
| 2005/0001113 | A1 * | 1/2005 | Sullivan | A63H 3/10 248/127 |
| 2011/0075423 | A1 * | 3/2011 | Van De Ven | F21V 17/02 362/249.02 |
| 2014/0265930 | A1 * | 9/2014 | Harris | H05B 33/0842 315/307 |
| 2017/0038044 | A1 * | 2/2017 | Matsuda | F21S 8/061 |
| 2018/0274761 | A1 * | 9/2018 | Green | F21S 8/026 |
| 2018/0335183 | A1 * | 11/2018 | Green | F21V 21/03 |
| 2018/0356086 | A1 * | 12/2018 | Maxik | F21S 8/026 |
| 2019/0219236 | A1 * | 7/2019 | Ticktin | F21V 21/22 |

* cited by examiner

SNAP IN RETROFIT PANEL

RELATED APPLICATIONS

This patent application claims priority under 35 U.S.C. 119(e) of the U.S. Provisional Patent Application No. 62/170,536, filed on Jun. 3, 2015, and entitled "Snap In Retrofit Panel," which is hereby incorporated by reference in its entirety.

FIELD OF THE INVENTION

The present invention is generally directed to light fixtures. More specifically, the present invention is directed to a snap in retrofit panel for light fixtures.

BACKGROUND OF THE INVENTION

There is a shift toward LED lighting, and to replace fluorescent lighting in buildings and houses. In high cost regions, the labor cost to replace pre-existing light fixtures with fluorescent lighting is high. A troffer is an inverted trough serving as a support and reflector usually for a fluorescent lighting unit. Companies are developing methods of replacing a fluorescent lighting fixtures with LED lighting fixtures. One method simply remove the old fluorescent bulb with a new set of LEDs that are configured as a similar bulb structure that can simply be fitted to the existing fluorescent bulb sockets. Another method uses a trim kit that can be attached to a T-bar roof on the ceiling, and the LED attaches to the mounted trim kit.

SUMMARY OF THE INVENTION

Embodiments are directed to a retrofit lighting fixture and a method of retrofitting a pre-existing, already installed lighting fixture with the retrofit lighting fixture. In some embodiments, the pre-existing lighting fixture is a fluorescent lighting fixture that is retrofitted with an LED lighting fixture. As described herein, reference is made to an LED lighting fixture and corresponding LED components. It is understood that the retrofit lighting fixture and related concepts can be applied to other types of lighting fixtures. The LED lighting fixture is configured to be installed to a pre-existing, or already installed, lighting fixture. In some embodiments, the pre-existing lighting fixture is a fluorescent luminaire installed on or to a ceiling. The pre-existing lighting fixture has a troffer and a light source, such as a fluorescent diffuser or other light bulb. The troffer has a recessed center portion, or roof, and an outer perimeter edge, which together form a hollow inner cavity. The light source is mounted within the troffer cavity and to the center recessed portion. The pre-existing lighting fixture also includes electrical wiring that extends within the troffer cavity and is connected to the light source. Retrofitting the pre-existing lighting fixture with the LED lighting fixture includes first removing the pre-existing light source, such as the fluorescent diffuser, and exposing the pre-existing electrical wiring connections, such as by removing trim or cover pieces that prevent access to the pre-existing electrical wiring connections. A fundamental concept here is that this is a retrofit. The pre-existing troffer does not have to be removed and is instead used as a mount for the retrofit lighting fixture.

The LED lighting fixture includes an LED panel. In some embodiments, the LED panel is about ¼ inch thick, which is thinner than conventional lighting panels. The LED panel includes one or more LEDs and related circuitry mounted to a substrate. The LED panel can be any replacement LED light source, whether planar or volumetric in nature. In a planar configuration, the LED emitters are placed around the periphery of a polymer sheet. The light emitted from the LEDs travels through the substrate from the edges, and then refracts down through the bottom surface of the substrate to illuminate underneath. In a volumetric configuration, the LED emitters are generally placed in a horizontal plane and the light is emitted light directly down to the underlying area, sometimes through a diffuse polymer sheet. It is understood that other types of configurations are also contemplated. Instead of trying to position the LED panel inside the troffer, the LED panel is positioned in front of the pre-existing lighting fixture. To accomplish this with minimal tooling and modifications, a magnet is used. The magnet is connected to one end of a spring or spring-like part. In some embodiments, a coiled spring is used. The other end of the spring is connected to the LED panel. It is understood that other methods can be used to create a tensile force connecting the LED panel to the magnet. The magnet is positioned against the inner surface of the troffer cavity. The troffer must be made of a material to which the magnet securely adheres, such as sheet metal. The spring force of the spring pulls the LED panel against the outer perimeter of the troffer.

In an aspect, a retrofit lighting fixture is directed to retrofitting a pre-existing lighting. The pre-existing lighting fixture includes electrical wiring and a troffer, the troffer having a recessed center portion and an outer perimeter edge, which together form a hollow inner cavity, the electrical wiring extending into the cavity. The retrofit lighting fixture includes a lighting panel, a spring and a magnet. The lighting panel includes lighting panel electrical wiring and one or more light sources coupled to the lighting panel electrical wiring. The lighting panel electrical wiring is further coupled to the electrical wiring of the pre-existing lighting. The spring has a first end and a second end, wherein the first end of the spring is coupled to the lighting panel and the second end is coupled to the magnet. The magnet is further coupled to the recessed center portion of the troffer, and the spring is configured to pull the lighting panel against the outer perimeter edge of the troffer. In some embodiments, the lighting panel comprises a LED panel having one or more LEDs as the one of more light sources. In some embodiments, the lighting panel further comprises alignment blocks configured to properly align the lighting panel with the troffer. In some embodiments, the retrofit lighting fixture further comprises a safety cable having a first end and a second end, wherein the first end of the safety cable is connected to the lighting panel and the second end of the safety cable is connected to the troffer.

In another aspect, a lighting fixture retrofit assembly is disclosed. The lighting fixture retrofit assembly includes a pre-existing lighting fixture, a lighting panel, a spring and a magnet. The pre-existing lighting fixture comprises electrical wiring and a troffer, the troffer having a recessed center portion and an outer perimeter edge, which together form a hollow inner cavity, the electrical wiring extending into the cavity. The lighting panel comprises lighting panel electrical wiring and one or more light sources coupled to the lighting panel electrical wiring. The lighting panel electrical wiring is further coupled to the electrical wiring of the pre-existing lighting. The spring has a first end coupled to the lighting panel and a second end coupled to the magnet. The magnet is further coupled to the recessed center portion of the troffer, and the spring is configured to pull the lighting panel against the outer perimeter edge of the troffer. In some embodiments, the lighting panel comprises a LED panel having one or more LEDs as the one of more light sources. In some embodiments, the lighting panel further comprises alignment blocks configured to properly align the lighting panel with the troffer. In some embodiments, the alignment blocks are configured to align with corners of a T-bar roof. In some embodiments, the light fixture retrofit assembly further comprises a safety cable having a first end and a second end, wherein the first end of the safety cable is connected to the lighting panel and the second end of the safety cable is connected to the troffer. In some embodiments, the pre-existing lighting fixture is a fluorescent luminaire installed on or to a ceiling.

In yet another aspect, a method of retrofitting a pre-existing, already installed lighting fixture with a retrofit lighting fixture is disclosed. The method includes accessing the pre-existing lighting fixture, wherein the pre-existing lighting fixture has a troffer and a light source connected to electrical wiring within a troffer cavity. The method further includes removing the light source and exposing the electrical wiring within the troffer cavity. The method further includes positioning the retrofit lighting fixture proximate the troffer, wherein the retrofit lighting fixture comprises a lighting panel, electrical wiring electrically coupled to the lighting panel, a spring having a first end connected to the lighting panel and a magnet connected to a second end of the spring. The method further includes connecting the electrical wiring of the lighting panel of the retrofit lighting fixture to the electrical wiring within the troffer cavity, and attaching the magnet to the troffer by stretching the spring. The method further includes enabling the spring to contract thereby pulling the lighting panel toward the troffer and guiding the lighting panel into position against the troffer. In some embodiments, the pre-existing lighting fixture is a fluorescent luminaire installed on or to a ceiling. In some embodiments, the troffer has a recessed troffer roof and an outer perimeter edge, which together form a hollow inner cavity. In some embodiments, the light source of the pre-existing lighting fixture is mounted within the troffer cavity and to the troffer roof, and the electrical wiring extends within the troffer cavity and is connected to the light source. In some embodiments, attaching the magnet to the troffer comprises attaching the magnet to the troffer roof. In some embodiments, the light source is a fluorescent diffuser or other light bulb. In some embodiments, the retrofit lighting fixture further comprises a safety cable having a first end and a second end, wherein the first end of the safety cable is attached to the lighting panel, wherein the method further comprises attaching the second end of the safety cable to the troffer prior to attaching the magnet to the troffer. In some embodiments, attaching the magnet to the troffer comprises stretching the spring beyond a spring steady state length. In some embodiments, while positioning the retrofit lighting fixture proximate the troffer and attaching the magnet to the troffer, maintaining a separation between the lighting panel and the troffer.

BRIEF DESCRIPTION OF THE DRAWINGS

Several example embodiments are described with reference to the drawings, wherein like components are provided with like reference numerals. The example embodiments are intended to illustrate, but not to limit, the invention. The drawings include the following figures.

DETAILED DESCRIPTION OF THE EMBODIMENTS

Embodiments of the present application are directed to a retrofit lighting fixture. Those of ordinary skill in the art will realize that the following detailed description of the retrofit lighting fixture is illustrative only and is not intended to be in any way limiting. Other embodiments of the retrofit lighting fixture will readily suggest themselves to such skilled persons having the benefit of this disclosure.

Reference will now be made in detail to implementations of the retrofit lighting fixture as illustrated in the accompanying drawings. The same reference indicators will be used throughout the drawings and the following detailed description to refer to the same or like parts. In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 2:
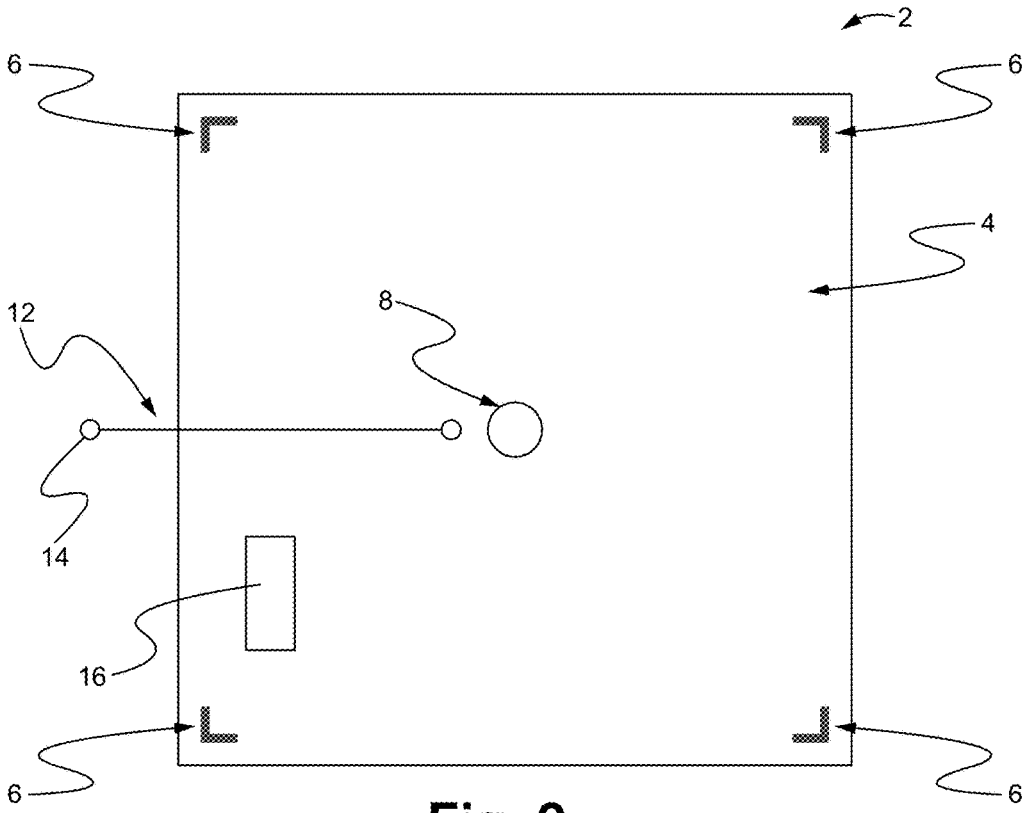
FIG. 2 illustrates a top down view of the retrofit lighting fixture of FIG. 1.
Figure 1:
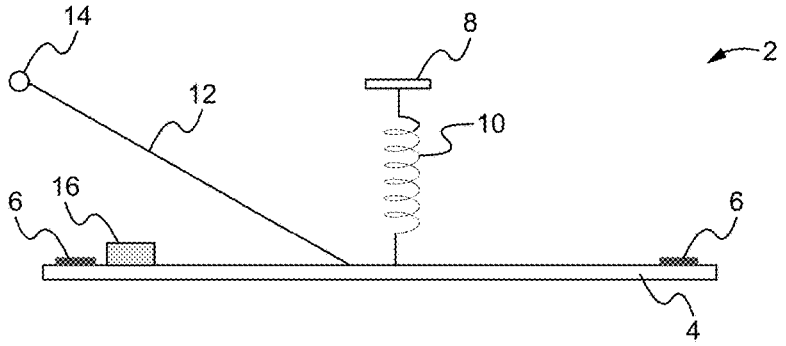
FIG. 1 illustrates a side view of a retrofit lighting fixture according to some embodiments.

FIG. 1 illustrates a side view of a retrofit lighting fixture according to some embodiments. FIG. 2 illustrates a top down view of the retrofit lighting fixture of FIG. 1. In these exemplary embodiments, the retrofit lighting fixture is configured as a LED lighting fixture. The LED lighting fixture 2 includes a LED panel 4 that has one or more LEDs and related circuitry. A driver circuit and wiring 16 is coupled to the LED panel 4. A first end of a spring 10 is attached to the LED panel 4 and a second end of the spring 10 is attached to a magnet 8. In some embodiments, alignment blocks are added to the LED panel so as to properly align the LED panel with the troffer. Once properly aligned, the alignment blocks also prevent the LED panel from rotating out of position. In the exemplary configuration shown in FIGS. 1 and 2, there are four alignment blocks 6. In some embodiments, a safety cable 12 is connected to the LED panel 4. The safety cable provides a separate method of attachment to meet certain safety requirements. A first end of the safety cable 12 is attached to the LED panel 4. A second end of the safety cable 12 is attached to the troffer. In some embodiments, the safety cable 12 includes a captured sheet metal screw 14 at a first end of the safety cable 12. The captured sheet metal screw is a self-taping screw that does not require a screw hole to be previously drilled. In other embodiments, another magnet is used instead of the captured sheet metal screw.

Figure 3:
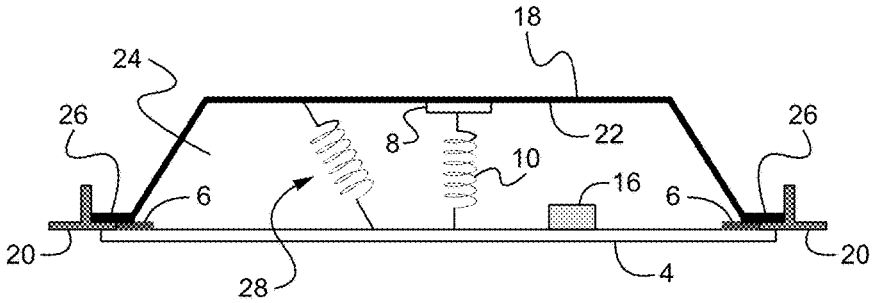
FIG. 3 illustrates the LED lighting fixture mounted to pre-existing lighting fixture according to some embodiments.

FIG. 3 illustrates the LED lighting fixture 2 mounted to pre-existing lighting fixture according to some embodiments. The pre-existing lighting fixture is shown in FIG. 3 in cut-out side view. The pre-existing lighting fixture includes a troffer 18. The troffer 18 has a recessed center portion, referred to as troffer roof 22, and an outer perimeter edge 26. The troffer roof 22 and the outer perimeter edge 26 define the boundaries of an inner hollow cavity 24. In the case where the LED lighting fixture 2 includes alignment blocks 6, the alignment blocks 6 are positioned against the outer perimeter edge 26 of the troffer 18 when the LED lighting fixture 2 is installed in position. In the case where the LED lighting fixture does not include alignment blocks, the LED panel is positioned against the outer perimeter edge of the troffer when the LED lighting fixture is installed in position.

The LED panel 4 is wired into the electrical wiring (not shown) already present for the pre-existing lighting fixture via the driver circuit and wiring 16. The pre-existing electrical wiring connection is accessed within the cavity 24 of the troffer 18. Instead of having to remove the pre-existing troffer, or add or remove brackets/snaps or other mounting apparatus as in the prior art, the LED lighting fixture 2 is mounted to the pre-existing troffer 18 by attaching the magnet 8 to the troffer roof 22. The magnet adheres to the troffer as long as the troffer is made of a magnetically attractive material, such as steel. The spring tension draws the LED lighting fixture 2 against the front of the existing fixture. The magnet 8 holds in place against the troffer roof 22 and the spring tension of the spring 10 holds the LED panel 4, or alignment blocks 6, in place against the outer perimeter edges 26 of the troffer 18.

In some embodiments, the LED panel 4 weighs less than 10 pounds and the LED lighting fixture requires a 4× pull force by the mounting hardware, such as the magnet 8. A 0.75 inch diameter×0.125 inch thick N52 Neodymium magnet with backer produces roughly 44.5 pounds of holding force.

Figure 4:
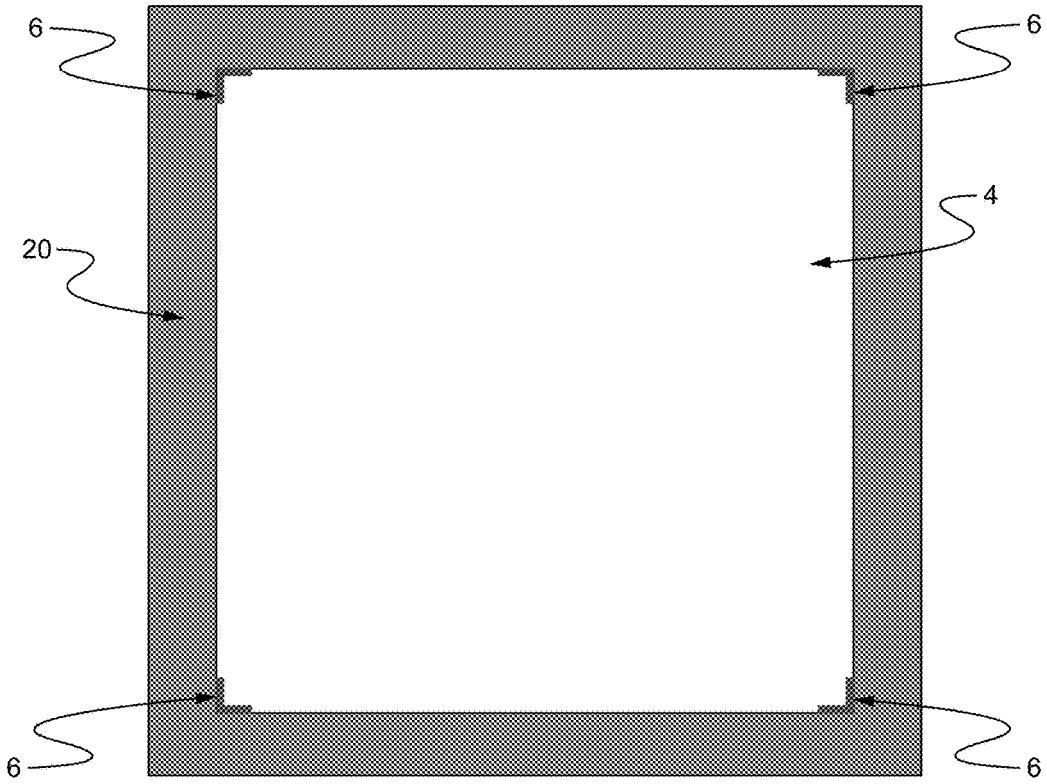
FIG. 4 illustrates a top down view of the LED panel installed against the T-bar roof.

In some embodiments, the pre-existing lighting fixture is mounted to a T-bar roof 20. In this case, the alignment blocks 6 are configured so as to align with the inner corners of the T-bar roof when the LED panel 4 is properly aligned. FIG. 4 illustrates a top down view of the LED panel 4 installed against the T-bar roof 20. FIG. 4 is shown with the troffer 8 removed, and only the LED panel 4 and the alignment blocks 6 of the LED lighting fixture 2 shown. As shown in FIG. 4, the alignment blocks 6 are aligned with the inner corners of the T-bar roof 20.

In some embodiments, the safety cable is a cord. In other embodiments, the safety cable is another spring, such as the coiled spring safety cable 28 shown in FIG. 3. A length of the safety cable 12, 28, whether it be a length of a cord or the extendibility of a spring, is sufficient to allow an installer to reach between the outer perimeter edge 26 of troffer 18 and the LED panel 4 to access the electrical wiring within the cavity 24. Similarly, the spring is sufficiently extendable to allow the workman access. In this manner, the spring functions to both allow access within the space between the troffer and the LED panel during installation and to pull the LED panel against the troffer to complete the retrofit. During installation, the safety cable 12, 28 is installed first, while the magnet 8 is not yet attached to the troffer 18. In this state, the LED panel 4 hangs from the safety cable 12, 28. The safety cable 12, 28 is long enough so that the LED panel 4 hangs below the outer perimeter edge 26 of the troffer 18, thereby allowing the installer access to the cavity 24, and connect the wiring. In some embodiments, the electrical wiring connection includes two electrical wiring connections using standard electrician wiring nuts. The magnet 8 is then placed against the troffer roof 22 and the spring force pulls the LED panel 4 against the outer perimeter edge 26 of the troffer 18.

In an alternative embodiment, magnets can be attached to each corner of the LED panel, and the LED panel is aligned with the pre-existing troffer so that the magnets attach to the outer perimeter edge of the troffer. In some embodiments, the pre-existing troffer is made of steel, which is readily attachable by a magnet. However, in some applications, the troffer is mounted to a T-bar roof ceiling structure, typically made of aluminum, which has negligible magnetic attraction. In such an application, magnets are to be properly position in the corners of the LED panel so as to ensure proper alignment with the outer perimeter edge of the troffer, and not the T-bar roof.

Figure 5:
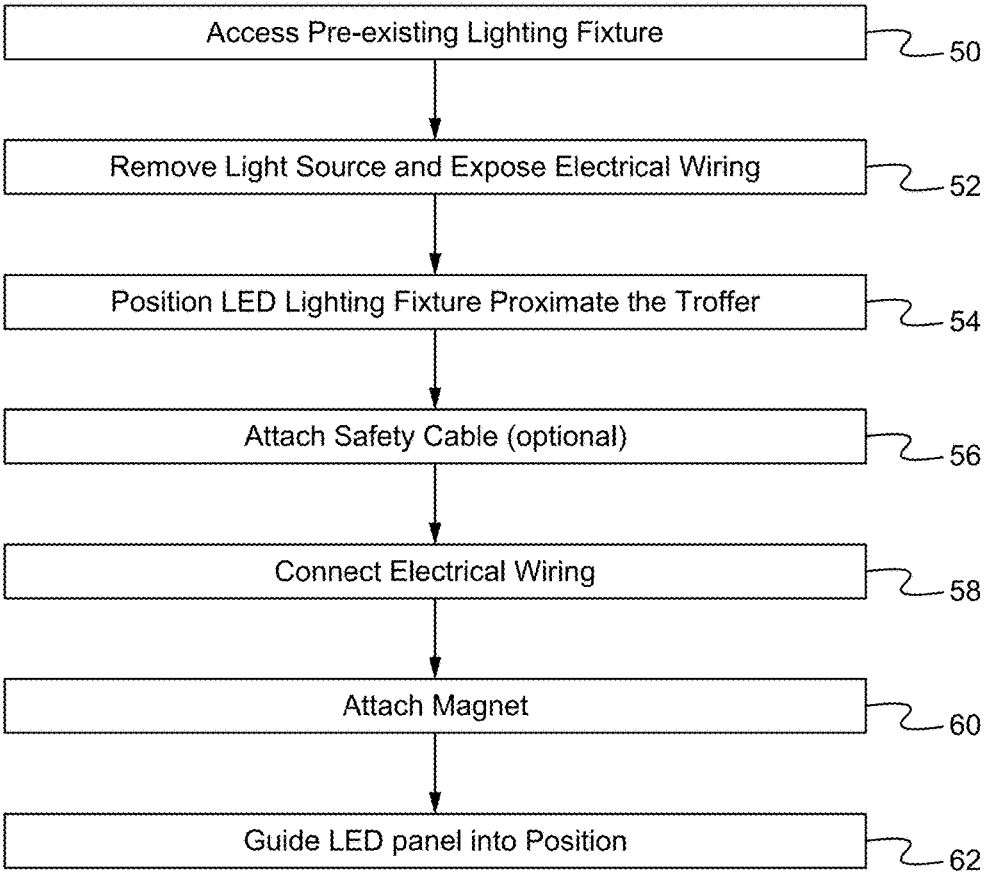
FIG. 5 illustrates a method of retrofitting a pre-existing, already installed lighting fixture with a retrofit lighting fixture according to some embodiments.

FIG. 5 illustrates a method of retrofitting a pre-existing, already installed lighting fixture with a retrofit lighting fixture according to some embodiments. The method of FIG. 5 is described in terms of the retrofit lighting fixture being the LED lighting fixture 2 of FIGS. 1-3. It is understood that the method can be applied to alternative appropriately configured retrofit lighting fixtures. At a step 50, the pre-existing lighting fixture is accessed. In some embodiments, the pre-existing lighting fixture is a fluorescent luminaire installed on or to a ceiling. The pre-existing lighting fixture has a troffer and a light source, such as a fluorescent diffuser or other light bulb. The troffer has the recessed center portion, or troffer roof, and the outer perimeter edge, which together form the hollow inner cavity. The light source is mounted within the troffer cavity and to the troffer roof. The pre-existing lighting fixture also includes electrical wiring that extends within the troffer cavity and is connected to the light source.

At the step 52, the light source is removed from the pre-existing lighting fixture and the electrical wiring within the troffer cavity is exposed. At the step 54, the LED lighting fixture is positioned proximate the troffer. In some embodiments, the installer holds the LED lighting fixture proximate the outer perimeter edge of the troffer.

At the step 56, a first end of the safety cable of the LED lighting fixture is attached to the troffer within the troffer cavity. In some embodiments, the second end of the safety cable is connected to the troffer roof of the troffer. The LED lighting panel can be allowed to hang from the safety cable for subsequent electrical wiring. Installation of the safety cable is an optional step. In some applications, the retrofit lighting fixture does not include a safety cable. In some embodiments, the safety cable is a cord. In other embodiments, the safety cable is a spring.

At the step 58, electrical wiring of the LED panel is connected to the electrical wiring within the troffer cavity. In some embodiments, DC crimp connectors are used to connect each corresponding pair of wires.

At the step 60, the magnet is attached to the troffer by stretching the spring. In some embodiments, the magnet is attached to the troffer roof. To attach the magnet to the troffer, the spring is stretched beyond its spring steady state length. In some embodiments, the installer holds the LED lighting fixture proximate the outer perimeter edge of the troffer while also reaching within the troffer cavity and moving the magnet, thereby stretching the spring, onto the troffer roof. While positioning the retrofit lighting fixture proximate the troffer and attaching the magnet to the troffer roof, a separation between the LED panel and the outer perimeter edge of the troffer is maintained.

At the step 62, the LED panel is guided into position against the outer perimeter of the troffer by letting the spring pull the LED panel toward the troffer cavity. In the case where the LED lighting fixture includes alignment blocks positioned on the LED panel, the alignment blocks ensure the LED panel is aligned properly with the troffer. In the case where the troffer is aligned with a T-bar roof, the alignment blocks are positioned against the inner corners of the T-bar roof, thereby aligning the lighting panel within the opening of the T-bar roof.

The present application has been described in terms of specific embodiments incorporating details to facilitate the understanding of the principles of construction and operation of the retrofit lighting fixture. Many of the components shown and described in the various figures can be interchanged to achieve the results necessary, and this description should be read to encompass such interchange as well. As such, references herein to specific embodiments and details thereof are not intended to limit the scope of the claims appended hereto. It will be apparent to those skilled in the art that modifications can be made to the embodiments chosen for illustration without departing from the spirit and scope of the application.

What is claimed is:

1. A retrofit lighting fixture for retrofitting a pre-existing lighting fixture with the retrofit lighting fixture, wherein the pre-existing lighting fixture comprises electrical wiring and a troffer, the troffer having a recessed center portion and an outer perimeter edge, which together form a hollow inner cavity, the electrical wiring extending into the cavity, wherein the retrofit lighting fixture comprises:

a. a lighting panel comprising lighting panel electrical wiring and one or more light sources coupled to the lighting panel electrical wiring, wherein the lighting panel electrical wiring is further coupled to the electrical wiring of the pre-existing lighting fixture;

b. a spring having a most distal first end and a most distal second end, wherein the most distal first end of the spring is connected to the lighting panel, wherein the spring is configured to expand and contract along a longitudinal axis of the spring, and the most distal first end of the spring and the most distal second end of the spring move in opposite directions when the spring is expanded, and the most distal first end of the spring and the most distal second end of the spring move toward each other when the spring is contracted; and c. a magnet coupled to the most distal second end of the spring, wherein the magnet is further coupled to the recessed center portion of the troffer, and the spring is configured to pull the lighting panel against the outer perimeter edge of the troffer.

2. The retrofit lighting fixture of claim 1 wherein the lighting panel comprises a LED panel having one or more LEDs as the one or more light sources.

3. The retrofit lighting fixture of claim 1 wherein the lighting panel further comprises alignment blocks configured to align the lighting panel with the troffer.

4. The retrofit lighting fixture of claim 1 further comprising a safety cable having a first end and a second end, wherein the first end of the safety cable is connected to the lighting panel and the second end of the safety cable is connected to the troffer.

5. A lighting fixture retrofit assembly comprising:

a. a pre-existing lighting fixture comprising electrical wiring and a troffer, the troffer having a recessed center portion and an outer perimeter edge, which together form a hollow inner cavity, the electrical wiring extending into the cavity;

b. a lighting panel comprising lighting panel electrical wiring and one or more light sources coupled to the lighting panel electrical wiring, wherein the lighting panel electrical wiring is further coupled to the electrical wiring of the pre-existing lighting fixture;

b. a spring having a most distal first end and a most distal second end, wherein the most distal first end of the spring is connected to the lighting panel, wherein the spring is configured to expand and contract along a longitudinal axis of the spring, and the most distal first end of the spring and the most distal second end of the spring move in opposite directions when the spring is expanded, and the most distal first end of the spring and the most distal second end of the spring move toward each other when the spring is contracted; and c. a magnet coupled to the most distal second end of the spring, wherein the magnet is further coupled to the recessed center portion of the troffer, and the spring is configured to pull the lighting panel against the outer perimeter edge of the troffer.

6. The light fixture retrofit assembly of claim 5 wherein the lighting panel comprises a LED panel having one or more LEDs as the one or more light sources.

7. The light fixture retrofit assembly of claim 5 wherein the lighting panel further comprises alignment blocks configured to align the lighting panel with the troffer.

8. The light fixture retrofit assembly of claim 7 wherein the alignment blocks are configured to align with corners of a T-bar roof to align the lighting panel with the troffer, and perimeter edges of the aligned lighting panel rest against the T-bar roof.

9. The light fixture retrofit assembly of claim 5 further comprising a safety cable having a first end and a second end, wherein the first end of the safety cable is connected to the lighting panel and the second end of the safety cable is connected to the troffer.

10. The light fixture retrofit assembly of claim 5 wherein the pre-existing lighting fixture is a fluorescent luminaire installed on or to a ceiling.

11. A method of retrofitting a pre-existing, already installed lighting fixture with a retrofit lighting fixture, the method comprising:

a. accessing the pre-existing lighting fixture, wherein the pre-existing lighting fixture has a troffer and a light source connected to electrical wiring within a troffer cavity;

b. removing the light source and exposing the electrical wiring within the troffer cavity;

c. positioning the retrofit lighting fixture proximate the troffer, wherein the retrofit lighting fixture comprises a lighting panel, electrical wiring electrically coupled to the lighting panel, a spring having a most distal first end connected to the lighting panel and a magnet connected to a most distal second end of the spring, wherein the spring is configured to expand and contract along a longitudinal axis of the spring, and the most distal first end of the spring and the most distal second end of the spring move in opposite directions when the spring is expanded, and the most distal first end of the spring and the most distal second end of the spring move toward each other when the spring is contracted;

d. connecting the electrical wiring of the lighting panel of the retrofit lighting fixture to the electrical wiring within the troffer cavity;

e. attaching the magnet to the troffer by stretching the spring; and f. enabling the spring to contract thereby pulling the lighting panel toward the troffer and guiding the lighting panel into position against an outer perimeter edge of the troffer.

12. The method of claim 11 wherein the pre-existing lighting fixture is a fluorescent luminaire installed on or to a ceiling.

13. The method of claim 11 wherein the troffer has a recessed troffer roof and an outer perimeter edge, which together form a hollow inner cavity.

14. The method of claim 13 wherein the light source of the pre-existing lighting fixture is mounted within the troffer cavity and to the troffer roof, and the electrical wiring extends within the troffer cavity and is connected to the light source.

15. The method of claim 13 wherein attaching the magnet to the troffer comprises attaching the magnet to the troffer roof.

16. The method of claim 11 wherein the light source is a fluorescent diffuser or other light bulb.

17. The method of claim 11 wherein the retrofit lighting fixture further comprises a safety cable having a first end and a second end, wherein the first end of the safety cable is attached to the lighting panel, wherein the method further comprises attaching the second end of the safety cable to the troffer prior to attaching the magnet to the troffer.

18. The method of claim 11 wherein attaching the magnet to the troffer comprises stretching the spring beyond a spring steady state length.

19. The method of claim 11 wherein while positioning the retrofit lighting fixture proximate the troffer and attaching the magnet to the troffer, maintaining a separation between the lighting panel and the troffer.

20. The retrofit lighting fixture of claim 1 wherein the lighting panel is a planar substrate having the lighting panel electrical wiring and one or more light sources disposed thereon.

21. The retrofit lighting fixture of claim 20 wherein an entirety of the planar substrate is external to the hollow inner cavity.

22. The retrofit lighting fixture of claim 1 wherein the lighting panel further comprises alignment blocks attached at a first surface of the lighting panel, and the pre-existing lighting fixture further comprises a T-bar roof, further wherein the alignment blocks are configured to align with corners of the T-bar roof to align the lighting panel with the troffer, and perimeter edges of the aligned lighting panel rest against the T-bar roof.

23. The method of claim 11 wherein the lighting panel further comprises alignment blocks attached at a first surface of the lighting panel, and the pre-existing lighting fixture further comprises a T-bar roof, further wherein the alignment blocks are configured to align with corners of the T-bar roof to align the lighting panel with the troffer, and perimeter edges of the aligned lighting panel rest against the T-bar roof.

* * * * *